US007116923B2

(12) United States Patent
Kishi et al.

(10) Patent No.: US 7,116,923 B2
(45) Date of Patent: Oct. 3, 2006

(54) FUSER PROVIDED WITH AUXILIARY POWER SUPPLY DEVICE TO OPERATE WITH VARYING POWER

(75) Inventors: Kazuhito Kishi, Kanagawa (JP); Yasuhisa Kato, Kanagawa (JP); Akiyasu Amita, Kanagawa (JP); Masami Okamoto, Kanagawa (JP); Yasutada Tsukioka, Chiba (JP); Hiromasa Takagi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/810,628

(22) Filed: Mar. 29, 2004

(65) Prior Publication Data

US 2004/0247334 A1 Dec. 9, 2004

(30) Foreign Application Priority Data

Apr. 1, 2003 (JP) ..... 2003-098056

(51) Int. Cl.
*G03G 15/20* (2006.01)

(52) U.S. Cl. ..... 399/69

(58) Field of Classification Search ..... 399/38, 399/67, 69

See application file for complete search history.

(56) References Cited

U.S. PATENT DOCUMENTS

| | | | | |
|---|---|---|---|---|
| 4,843,214 | A | 6/1989 | Higashi et al. | |
| 4,992,923 | A * | 2/1991 | Mitsuya et al. | 363/61 |
| 5,229,577 | A * | 7/1993 | Matsuura et al. | 219/497 |
| 5,400,123 | A | 3/1995 | Sato et al. | |
| 5,457,522 | A * | 10/1995 | Haneda et al. | 399/176 |
| 5,481,089 | A * | 1/1996 | Furuta | 219/497 |
| 5,481,350 | A | 1/1996 | Yasui et al. | |
| 5,729,798 | A | 3/1998 | Yasui et al. | |
| 5,745,247 | A | 4/1998 | Yasui et al. | |
| 5,839,032 | A | 11/1998 | Yasui et al. | |
| 5,854,465 | A | 12/1998 | Kishi et al. | |
| 6,112,047 | A | 8/2000 | Kato et al. | |
| 6,134,418 | A | 10/2000 | Kato et al. | |
| 6,144,832 | A | 11/2000 | Nimura et al. | |
| 6,229,120 | B1 * | 5/2001 | Jewell | 219/486 |
| 6,239,864 | B1 | 5/2001 | Okamoto | |
| 6,263,185 | B1 | 7/2001 | Kato et al. | |
| 6,272,308 | B1 * | 8/2001 | Maeda et al. | 399/328 |
| 6,393,233 | B1 * | 5/2002 | Soulier | 399/88 |
| 6,394,446 | B1 | 5/2002 | Okamoto | |
| 6,411,795 | B1 | 6/2002 | Okamoto | |
| 6,542,705 | B1 * | 4/2003 | Fujita et al. | 399/69 |
| 6,819,889 | B1 * | 11/2004 | Okuda | 399/67 |
| 2004/0247334 | A1 | 12/2004 | Kishi et al. | |

FOREIGN PATENT DOCUMENTS

| | | |
|---|---|---|
| JP | 03-206484 | 9/1991 |
| JP | 2002-174988 | 6/2002 |
| JP | 2003-084621 | 3/2003 |

OTHER PUBLICATIONS

U.S. Appl. No. 11/049,717, filed Feb. 4, 2005, Matsusaka et al.

* cited by examiner

*Primary Examiner*—Diego Gutierrez
*Assistant Examiner*—Dixomara Vargas
(74) *Attorney, Agent, or Firm*—Oblon, Spivak, McClelland, Maier & Neustadt, P.C.

(57) ABSTRACT

An apparatus for fusing toner with a sheet includes an electricity storage device, a heating unit configured to generate heat based on electric power supplied from the electricity storage device, a fusing member configured to fuse the toner with the sheet through heat applied by the heating unit, and a control unit which changes a rated power of the heating unit.

13 Claims, 6 Drawing Sheets

FUSER PROVIDED WITH AUXILIARY POWER SUPPLY DEVICE TO OPERATE WITH VARYING POWER

BACKGROUND OF THE INVENTION

1. Field of the Invention

The present invention generally relates to fusers and image forming apparatuses, and particularly relates to a fuser which is provided with an electricity storage device for supplying power to a heating unit, and to an image forming apparatus having such a fuser provided therein.

2. Description of the Related Art

In image forming apparatuses such as copiers, printers, and facsimile machines, generally, a toner image is first formed on a sheet such as transfer paper by use of electrophotography, and is then fused with the sheet by heat applied by a fuser.

The fuser heats up a roller, a loop belt, or the like by heat generated by a heating unit responsive to power supply, and brings a fusing member comprised of the roller, the loop belt, or the like in contact with the sheet so as to heat the toner. Power supply to the heating unit has conventionally been a commercial AC power supply. In recent years, fusers that supply power to a heating unit by simultaneous use of an electricity storage device have also been developed (e.g., Japanese Patent Application Publication No. 2002-174988, paragraphs 0035–0041, FIG. 5).

When the fuser is activated from a standby state by switching on of main power supply, there is a need to shorten a wait period that passes before the apparatus becomes usable. In consideration of this, a plurality of heating units receive power from a commercial AC power supply and an electricity storage device, respectively, to heat up the fuser member. This makes it possible to rapidly raise temperature up to a level sufficient for the fusion of toner (i.e., reload temperature).

The related-art fusers have a drawback in that a switch for supplying power from an electricity storage device to a heating unit has a short operating life. Moreover, the heating unit that receives power supply from the electricity storage device also has a short operating life. These factors make it difficult to provide a fuser unit that is maintenance free.

Accordingly, there is a need for a fuser that supplies power from an electricity storage device to a heating unit and is maintenance free because of an extended operating life of a switch and a heating unit, and, also, there is a need for an image forming apparatus having such a fuser provided therein.

SUMMARY OF THE INVENTION

It is a general object of the present invention to provide a fuser and an image forming apparatus that substantially obviate one or more problems caused by the limitations and disadvantages of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by a fuser and an image forming apparatus particularly pointed out in the specification in such full, clear, concise, and exact terms as to enable a person having ordinary skill in the art to practice the invention.

To achieve these and other advantages in accordance with the purpose of the invention, the invention provides an apparatus for fusing toner with a sheet, including an electricity storage device, a heating unit configured to generate heat based on electric power supplied from the electricity storage device, a fusing member configured to fuse the toner with the sheet through heat applied by the heating unit, and a control unit which changes a rated power of the heating unit.

According to another aspect of the invention, the heating unit includes a plurality of heating units, and the control unit provides first couplings between the heating units and the electricity storage device in a first operation mode and second couplings between the heating units and the electricity storage device in a second operation mode.

According to another aspect of the invention, the first operation mode corresponds to a time period when the fusing member is heated from a temperature with no heat applied by the heating unit to a temperature suitable for fusing of the toner, and the second operation mode corresponds to a time period when heat is deprived from the fusing member by the sheet.

According to another aspect of the invention, the heating units are connected in parallel in the first operation mode, and are connected in series in the second operation mode.

According to another aspect of the invention, all the heating units receive the electric power in the first operation mode, and at least one but not all of the heating units receives the electric power in the second operation mode.

According to another aspect of the invention, the electricity storage device is a capacitor.

According to another aspect of the invention, an apparatus for fusing toner with a sheet includes a heating unit configured to generate heat, a fusing member configured to fuse the toner with the sheet through heat provided by the heating unit, and a control unit which controls the heating unit to generate a controlled quantity of heat, which is a first quantity in a first operation mode and is switched between a second quantity and a third quantity in a second operation mode, the first quantity being larger than the second quantity that is larger than the third quantity.

According to another aspect of the invention, the heating unit includes a first heating unit that receives electric power from a commercial AC power supply and a second heating unit that receives electric power from an electricity storage device.

According to another aspect of the invention, the first operation mode corresponds to a time period when the fusing member is heated from a temperature with no heat provided by the heating unit to a temperature suitable for fusing of the toner, and the second operation mode corresponds to a time period when heat is deprived from the fusing member by the sheet.

According to another aspect of the invention, an apparatus for forming an image includes an electrophotography unit configured to create a toner image through electrophotography and transfer the toner image onto a sheet, and a fuser configured to fuse toner of the toner image with the sheet, wherein the fuser includes an electricity storage device, a heating unit configured to generate heat based on electric power supplied from the electricity storage device, a fusing member configured to fuse the toner with the sheet through heat applied by the heating unit, and a control unit which changes a rated power of the heating unit.

According to another aspect of the invention, the heating unit includes a plurality of heating units, and the control unit provides first couplings between the heating units and the electricity storage device in a first operation mode and second couplings between the heating units and the electricity storage device in a second operation mode.

According to another aspect of the invention, the first operation mode corresponds to a time period when the fusing member is heated from a temperature with no heat applied by the heating unit to a temperature suitable for fusing of the toner, and the second operation mode corresponds to a time period when heat is deprived from the fusing member by the sheet.

According to another aspect of the invention, the heating units are connected in parallel in the first operation mode, and are connected in series in the second operation mode.

According to another aspect of the invention, all the heating units receive the electric power in the first operation mode, and at least one but not all of the heating units receives the electric power in the second operation mode.

According to another aspect of the invention, the electricity storage device is a capacitor.

According to another aspect of the invention, an apparatus for forming an image includes an electrophotography unit configured to create a toner image through electrophotography and transfer the toner image onto a sheet, and a fuser configured to fuse toner of the toner image with the sheet, wherein the fuser includes a heating unit configured to generate heat, a fusing member configured to fuse the toner with the sheet through heat provided by the heating unit, and a control unit which controls the heating unit to generate a controlled quantity of heat, which is a first quantity in a first operation mode and is switched between a second quantity and a third quantity in a second operation mode, the first quantity being larger than the second quantity that is larger than the third quantity.

According to another aspect of the invention, the heating unit includes a first heating unit that receives electric power from a commercial AC power supply and a second heating unit that receives electric power from an electricity storage device.

According to another aspect of the invention, the first operation mode corresponds to a time period when the fusing member is heated from a temperature with no heat provided by the heating unit to a temperature suitable for fusing of the toner, and the second operation mode corresponds to a time period when heat is deprived from the fusing member by the sheet.

According to another aspect of the invention, an apparatus for fusing toner with a sheet includes an electricity storage device, heating means for generating heat based on electric power supplied from the electricity storage device, a fusing member configured to fuse the toner with the sheet through heat applied by the heating unit, and means for changing a rated power of the heating means.

In the invention described above, the control unit controls the rated power of the heating unit or the quantity of heat generated by the heating unit, so the a larger quantity of heat can be provided to the fuser when the fuser undergoes initial activation, and a smaller quantity of heat can be provided to the fuser when sheets are supplied to the fuser. The smaller quantity of heat is set to such a level that the quantity of applied heat and the quantity of deprived heat are balanced during the period of sheet supply, thereby eliminating a need for on/off control of the heating unit. Even if there is a need for on/off control during the period of sheet supply due to a slight imbalance, the number of switching actions for on/off control is not so frequent as to shorten the life of switches.

Other objects and further features of the present invention will be apparent from the following detailed description when read in conjunction with the accompanying drawings.

DESCRIPTION OF THE PREFERRED EMBODIMENTS

In the following, an apparatus construction that serves as a basis for the invention will be described first.

Figure 1:
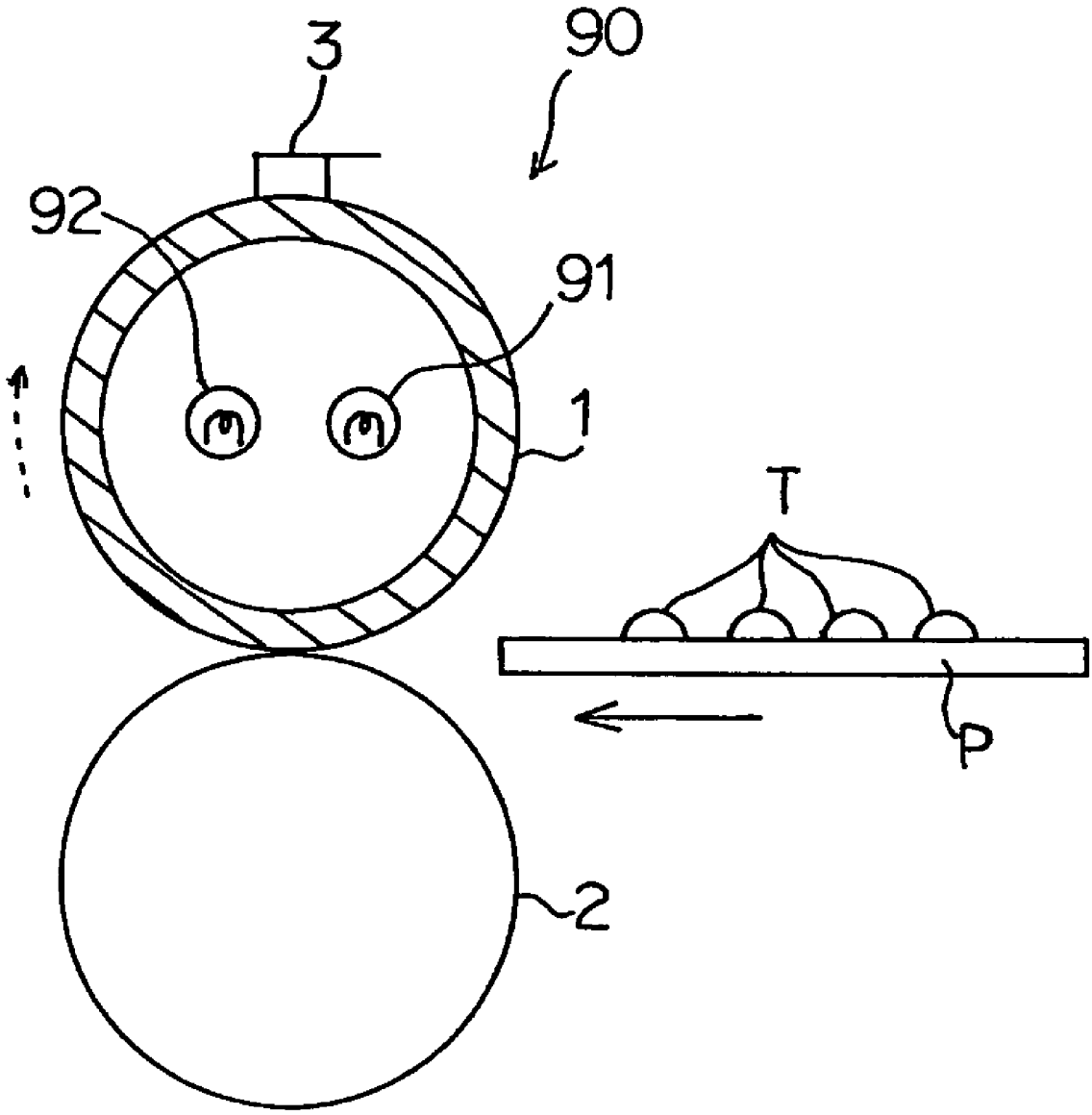
FIG. 1 is an illustrative drawing showing an example of a fuser.

FIG. 1 is an illustrative drawing showing an example of a fuser. In FIG. 1, a fusing roller 1 exemplifying a fusing member is in contact with a pressuring roller 2 that is urged by an urging unit (not shown) with a constant nip pressure. A drive mechanism (not shown) rotates the fusing roller 1 clockwise, and rotates the pressuring roller 2 counterclockwise. Moreover, the fusing roller 1 is provided with heaters 91 and 92 exemplifying heating units that generate heat in response to power supply. Through heat of the heaters 91 and 92, the surface of the fusing roller 1 is set to temperature sufficient for the fusing of toner. A temperature detecting unit 3, which detects temperature by coming in contact with the surface of the fusing roller 1, for example, monitors the surface temperature of the fusing roller 1.

When the image forming apparatus performs image forming processing, a sheet P carrying toner T attached by electrophotography passes through a nip portion between the heated fusing roller 1 and the pressuring roller 2, and is heated by the fusing roller 1 and the pressuring roller 2, resulting in the toner T being fused with the sheet P. In so doing, a predetermined temperature is required to fuse the toner T with the sheet P. Power supply to the heaters 91 and 92 is controlled such that the surface temperature of the fusing roller 1 is set at a reload temperature.

Figure 2:
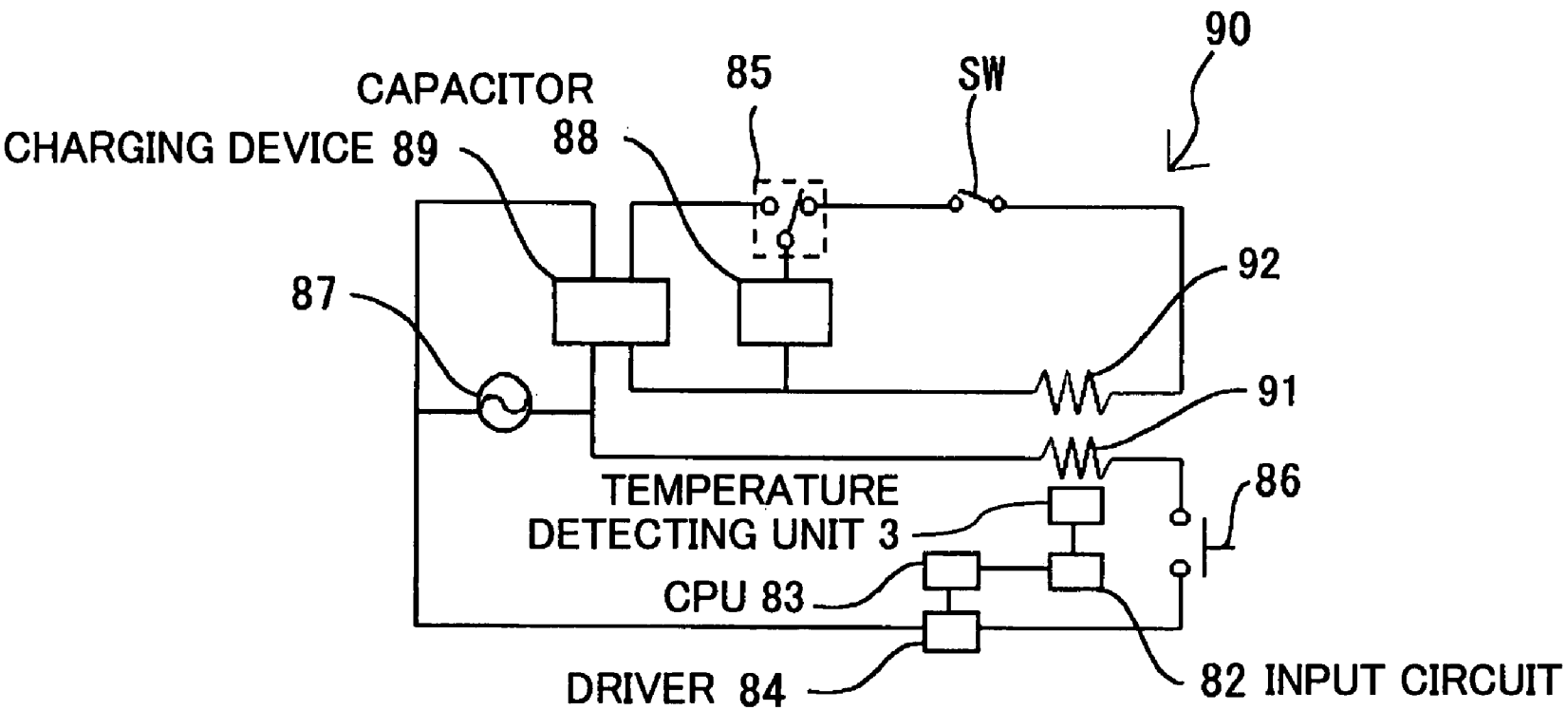
FIG. 2 is a circuit diagram showing an example of the circuit construction of a fuser.

FIG. 2 is a circuit diagram showing an example of the circuit construction of a fuser. In FIG. 2, the heater 91 generates heat in response to electric power supplied from an external power supply (commercial power supply) 87, and the heater 92 generates heat in response to electric power supplied from a capacitor 88 exemplifying an electricity storage device. The temperature of the fusing roller 1 is detected by the temperature detecting unit 3, and a detection signal is supplied to a CPU 83 through an input circuit 82. Based on the detection signal supplied from the temperature detecting unit 3, the CPU 83 controls the supply of electricity to the heater 91 through a driver 84 so as to set the surface temperature of the fusing roller 1 to a desired temperature. Further, the supply of electricity to the heater 92 is controlled by a switch SW. A switch 85 may be switched to couple the capacitor 88 to a charging device 89 for electrical charging.

With the provision as described above, a wait time before the fuser 90 becomes operational needs to be shortened when the fuser 90 is activated from a standby state in response to the power-on of main power supply, for example. To this end, the fusing roller 1, initially at low temperature without power to the heaters 91 and 92, is rapidly heated up to a reload temperature. This is done by supplying electric power to the heater 91 through the driver 84 and switch 86 from the external power supply 87 and by setting the switch 85 to supply electric power to the heater 92 from the capacitor 88. This eliminates a need for the provision of electric power for standby heating, and shortens a wait time before the fuser becomes usable through efficient heating of the fusing roller 1.

After the start of use of the apparatus, a plurality of sheets S may be constantly supplied to the fuser 90. When this happens, the heat of the fusing roller 1 is deprived by the sheets S, resulting in a drop of the temperature of the fusing roller 1. In order to avoid a drop of temperature below the temperature sufficient for the fusing of toner, additional electric power for a slight temperature increase is necessary. In FIG. 2, therefore, the control of supply of electric power is performed as follows. It should be noted that the supply of electric power to the heater 91 is active all the time.

At a first step, the switch SW is closed, so that electric power is supplied from the capacitor 88 to the heater 92 through the switch 85 (ON control). At a second step, the temperature of the fusing roller 1 rises due to heat generation by the heaters 91 and 92, and reaches the reload temperature. At a third step, the switch SW is opened, so that the supply of electric power from the capacitor 88 to the heater 92 is stopped (OFF control). This results in a state in which the fusing roller 1 is heated only by the heater 91. At a fourth step, as the sheets S continue to pass through the fuser 90, the temperature of the fusing roller 1 falls gradually until it reaches the lower limit of a temperature range suitable for the fusing of toner. Thereafter, the first steps through the fourth steps described above are repeated as many times as required until the supply of the sheets S is stopped. In this manner, the temperature of the fusing roller 1 is kept within the temperature range suitable for the fusing of toner.

As can be seen from the above description, the control of an on/off state of the switch SW is frequently carried out for the purpose of adjusting the supply of electric power to the heater 92. Because of this, the life of the switch SW reaches its end faster than other components included in the fuser 90.

Moreover, the heater 92 has a large rated power such as 1700 W for the purpose of rapid heating at the time of fuser activation. Therefore, rapid heating occurs even when the temperature of the fusing roller 1 drops during the time of routine sheet supply. As a result, a time period is extremely short from the start of heating at the first step to the stop of heating at the third step described above. During the time of routine sheet supply, therefore, intervals between repeated on/off controls are short. In general, a heater having a rated power exceeding 1000 W is believed to have a short life. The repeated start and stop of heating at short intervals as described above further exacerbate wear and tear of the heater 92. The life of the heater thus reaches its end faster than when the heater is used with less frequent on/off control. In this manner, the life of the switch SW and the heater 92 comes to an end after a short time of use, so that it is difficult to provide the fuser 90 as a maintenance-free unit.

In the following, a first embodiment of a fuser according to the invention will be described with reference to the accompanying drawings. The embodiment in the following description is only an example, and is not intended to be limiting in any manner.

Figure 3:
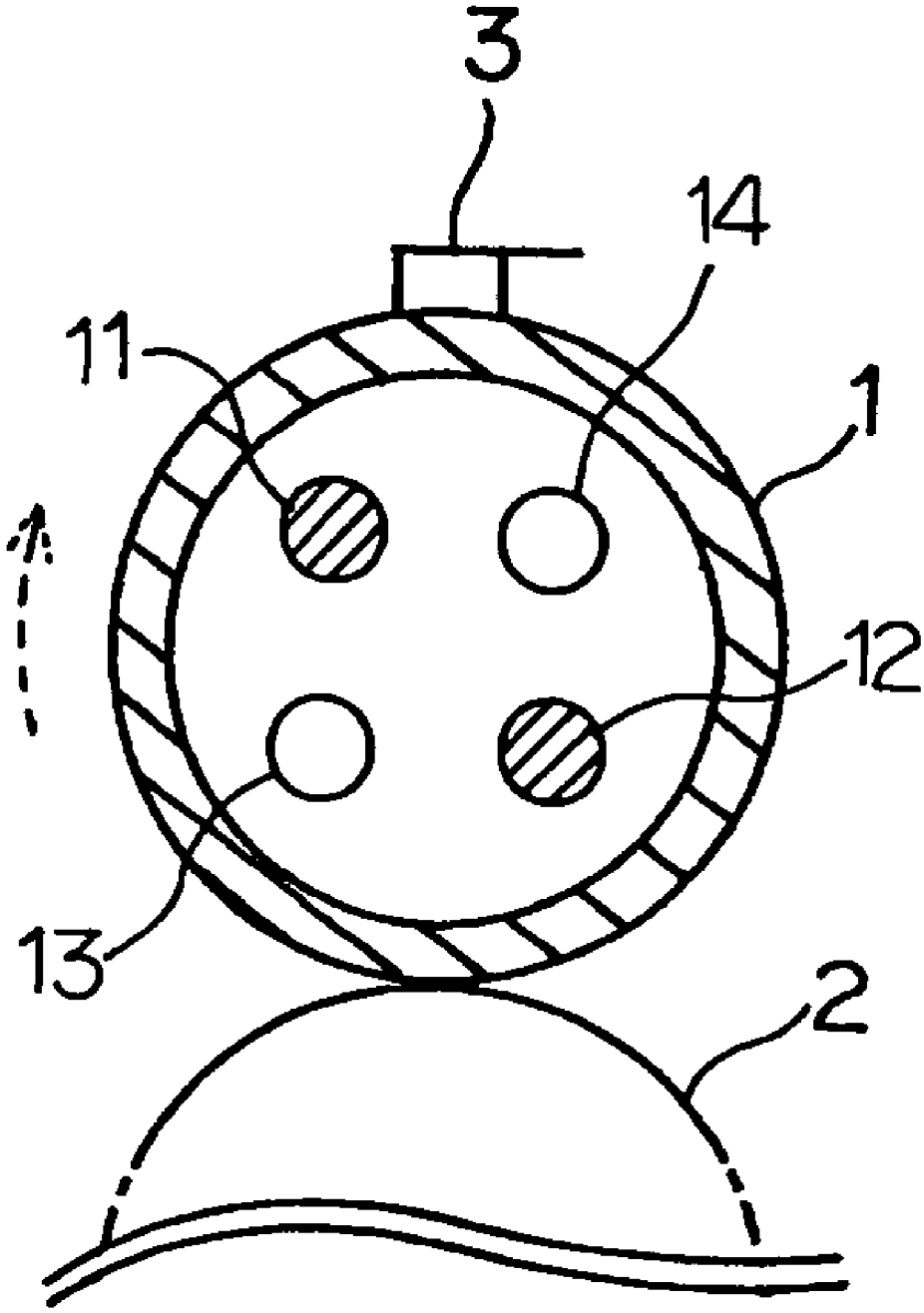
FIG. 3 is a cross-sectional view of a fuser according to the invention.

FIG. 3 is a cross-sectional view of a fuser according to the invention. A fuser 10 of FIG. 3 includes a heating unit comprised of heaters 11 and 12, a heating unit comprised of heaters 13 and 14, a fusing roller 1 heated by the heating units, a pressuring roller 2 that is urged against the fusing roller 1 with a predetermined nip pressure, and a temperature detecting unit 3 that is in contact with the fusing roller 1 to detect its surface temperature.

The fusing roller 1 is typically a roller of a hollow cylindrical shape, and may alternatively be a looped belt shape. The fusing roller 1 stays still at the time of activation of the fuser 10, and rotates clockwise as shown in the figure when a sheet is supplied.

The pressuring roller 2 is generally a roller having a cylindrical shape with its surface made of elastic material such as silicon rubber, and may alternatively be a looped belt shape. The urging of the pressuring roller 2 against the fusing roller 1 is achieved by a pressuring unit (not shown) that presses the pressuring roller 2 against the fusing roller 1 with a constant pressure. The pressuring roller 2 also stays still at the time of activation of the fuser 10, and rotates counterclockwise in the figure when a sheet is supplied. Drive to rotate the fusing roller 1 and the pressuring roller 2 is provided from a drive mechanism (not shown).

The temperature detecting unit 3 is situated at a temperature detecting position on an exterior portion of the fusing roller 1 that is directly opposite the nip portion across the center axis of the fusing roller 1. The temperature detecting unit 3 may be any one of a contact type, a non-contact type, a radiation thermometer, a thermocouple, etc., as long as it can properly detect the surface temperature of the fusing roller 1.

The heaters 11–14 are rod-shape heaters exemplifying heating units, and their cross-sectional shapes are illustrated in the drawing. The heaters 11 and 12 generate heat by electric power supplied from a capacitor exemplifying an electricity storage device, and the fusing roller 1 is heated by resulting radiation heat. The fusing roller 1 is maintained at proper temperature through electric power control that utilizes on/off switching or the like. The heaters 13 and 14 generate heat by electric power supplied from an external power supply capable of supplying electric power at all times such as a commercial AC power supply, and the fusing roller 1 is heated by resulting radiation heat.

The heaters 11–14 are disposed at equal intervals on a circumference that centers at the center axis of the fusing roller 1 and is at a predetermined distance from the interior surface of the fusing roller 1. The heaters receiving electric power from the capacitor and the heaters receiving electric power from the external power supply alternate on the circumference. In FIG. 3, the heaters 11, 13, 12, and 14 are arranged counterclockwise in the order named.

Figure 4A:
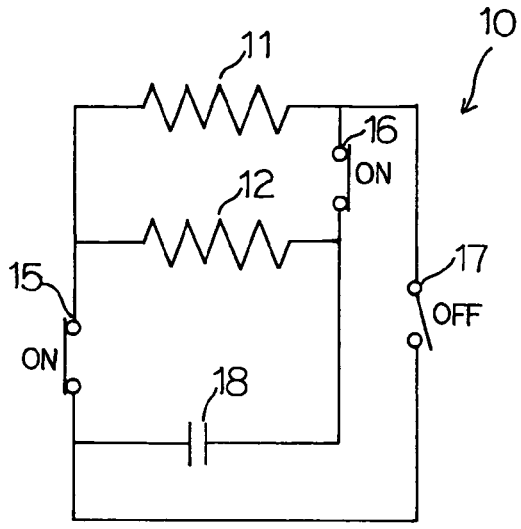
FIGS. 4A and 4B are circuit diagrams for explaining a total-rated-power control system according to a first embodiment.
Figure 4B:
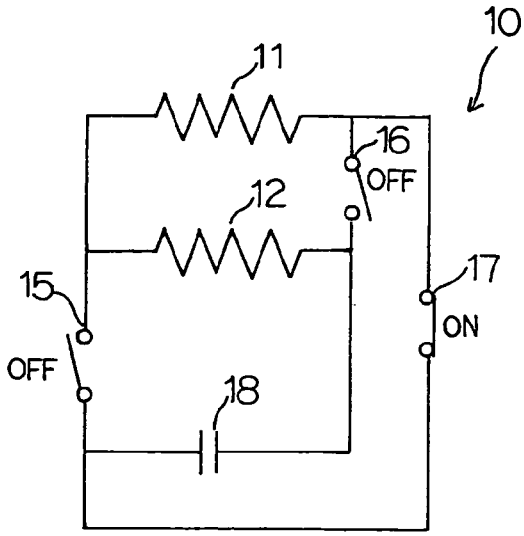

FIGS. 4A and 4B are circuit diagrams for explaining a total-rated-power control system (control unit) according to the first embodiment. Coupling between the heaters 11 and 12 and the capacitor 18 is controlled by a combination of on/off states of three switches 15 through 17. When the switches 15 and 16 are on, and the switch 17 is off, the heaters 11 and 12 are connected in parallel, and receive power supply from the capacitor 18, as shown in FIG. 4A. If the heaters 11 and 12 each have a rated power of 850 W, for example, a total rated power of the heating unit comprised of the heaters 11 and 12 becomes 1700 W. When the switches 15 and 16 are off, and the switch 17 is on, the heaters 11 and 12 are connected in series, and receive power supply from the capacitor 18, as shown in FIG. 4B. If the heaters 11 and 12 each have a rated power of 850 W, for example, a total rated power of the heating unit comprised of the heaters 11 and 12 becomes 420 W–430 W. The circuit construction of the fuser 10 other than connections between the heaters 11 and 12 and the capacitor 18 is the same as that of the circuit shown in FIG. 2.

The operation state of the fuser 10 includes an activation state and a sheet supply state. The activation state refers to a time period when the main power supply of the fuser is turned on or when the fuser returns from a standby state, during which a fusing member initially at low temperature without applied heat is heated up to a reload temperature. The sheet supply state refers to a time period when sheets are continuously supplied to the fuser 10 and deprive heat from the fusing roller 1, resulting in a drop of the temperature of the fusing roller 1.

When the fuser 10 is activated (e.g., undergoing a startup operation), the heaters 11 and 12 are connected in parallel as shown in FIG. 4A. With the fusing roller 1 being stationary without rotation, heat is applied as described in the following in response to a detected temperature of the fusing roller 1 detected by the temperature detecting unit 3.

At a first step, the fusing roller 1 is rapidly heated up by supplying electric power from the capacitor 18 to the heating unit comprised of the heaters 11 and 12 and having a total rated power 1700 W if the temperature of the fusing roller 1 detected by the temperature detecting unit 3 has not reached a predetermined temperature while the external power supply is applied to the heaters 13 and 14. At a second step, the supply of electric power from the capacitor 18 to the heaters 11 and 12 is stopped through switching or the like when the temperature of the fusing roller 1 detected by the temperature detecting unit 3 reaches the reload temperature. Alternatively, the temperature of the fusing roller 1 after the passage of a predetermined time is predicted based on the temperature of the fusing roller 1 and a temperature rise, and the supply of electric power from the capacitor 18 to the heaters 11 and 12 is stopped so as not to let the temperature exceed the predetermined reload temperature. At a third step, while electric power from the external power supply to the heaters 13 and 14 is continued to be supplied, the amount of electric power is suppressed to a level that is sufficient for maintaining the temperature of the fusing roller 1 at the reload temperature.

After this, the heaters 11 and 12 are connected in series as shown in FIG. 4B when a sheet is supplied to the fuser 10. With the fusing roller 1 rotating, heat is applied as described in the following in response to a detected temperature of the fusing roller 1 detected by the temperature detecting unit 3.

At a first step, the fusing roller 1 is heated by supplying electric power from the capacitor 18 to the heating unit comprised of the heaters 11 and 12 and having a total rated power of approximately 430 W while the external power supply is applied to the heaters 13 and 14. At a second step, heating as described above is gradual compared with the heating unit having the total rated power of 1700 W, so that the quantity of heat provided to the fusing roller 1 by the heaters 11–14 is balanced with the quantity of heat deprived by supplied sheets. As a result, the fusing roller 1 is maintained within a range of temperature suitable for the fusing of toner. This provision makes it possible to supply electric power from the capacitor 18 to the heaters 11 and 12 without frequent on/off control when sheets are supplied to the fuser 10.

As described above, the supply of electric power from the capacitor 18 to the heaters 11 and 12 does not require on/off control when sheets are supplied to the fuser 10. Because of this, the life of the on/off switches for supplying electric power from the capacitor 18 to the heating unit is extended, thereby providing the fuser 10 that is maintenance free. Moreover, each of the heaters 11 and 12 that receives electric power supply from the capacitor 18 has a rated power less than 1000 W, so that the life of heaters used in the fuser 10 is extended, thereby making it possible to provide the maintenance-free fuser 10. Furthermore, since the heaters 11 and 12 have the same rated power, the design of heater arrangement becomes easy, which helps to make the life of these heaters even. Also, when the fuser 10 is activated or when sheets are supplied, all the heaters 11–14 receive electric power and generate heat. It is thus possible to heat the fusing roller 1 uniformly without temperature variation along the circumference of the roller. This achieves stable toner fusing. Further, there is no need to consider the arrangement of a heater that is not used inside the hollow space of the fusing roller 1.

If the quantity of heat provided to the fusing roller 1 by the heaters 11–14 exceeds the quantity of heat deprived by the supplied sheet, the supply of electric power from the capacitor 18 to the heaters 11 and 12 is controlled as to its on/off state, thereby maintaining the fusing roller 1 within a temperature range suitable for the fusing of toner. It should be noted, however, that frequency of such on/off control is lowered compared with the conventional construction, so that the life of the switches for supplying electric power is extended relative to that of the conventional art.

In the following, a second embodiment of the fuser according to the invention will be described with reference to the accompanying drawings. A fuser 20 of the second embodiment has a total-rated-power control system (control unit) that is different from that of the first embodiment, and the remainder of the construction stays the same as the first embodiment. The embodiment in the following description is only an example, and is not intended to be limiting in any manner.

Figure 5:
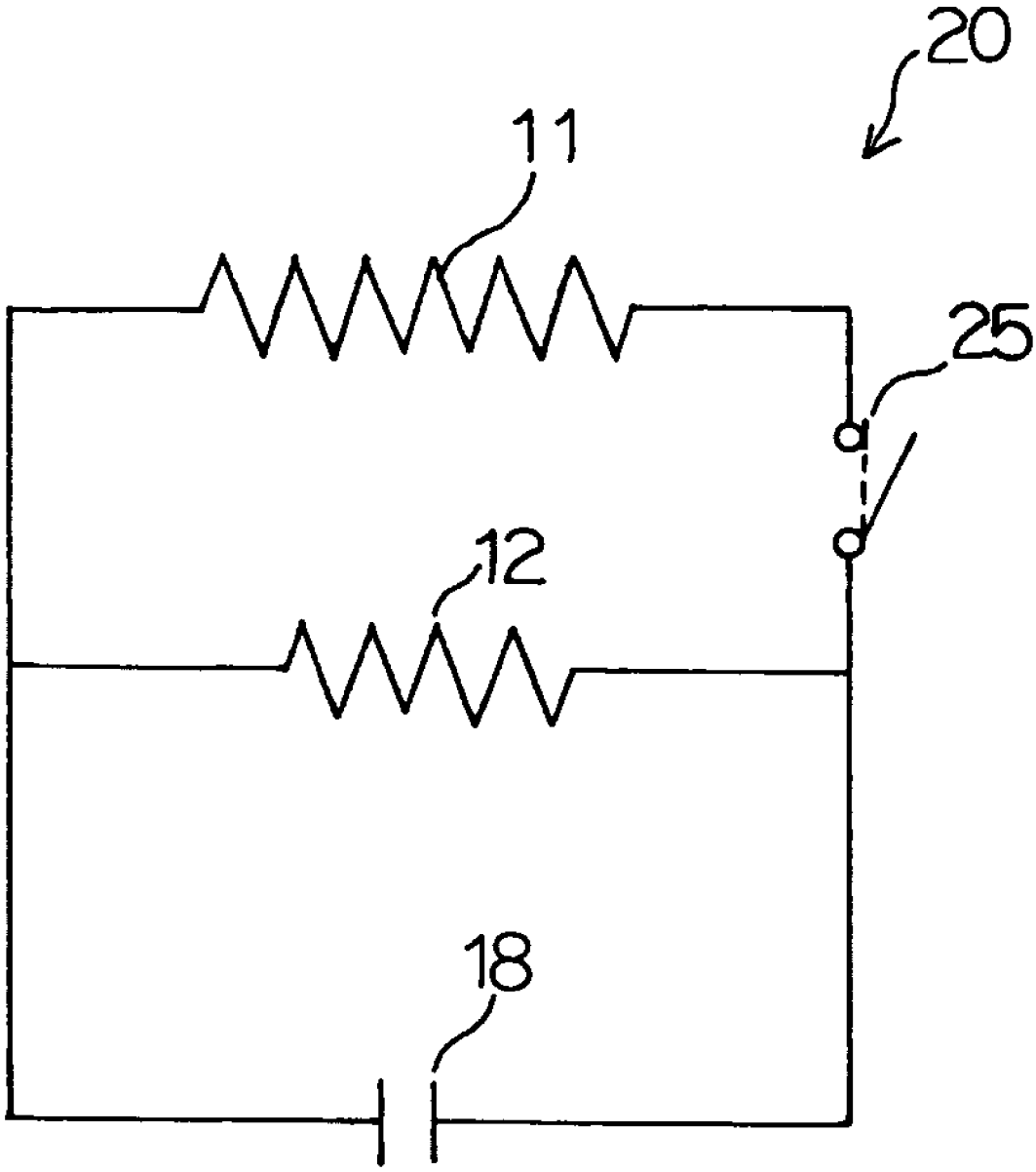
FIG. 5 is a circuit diagram for explaining a total-rated-power control system according to a second embodiment.

FIG. 5 is a circuit diagram for explaining a total-rated-power control system according to the second embodiment. Coupling between the heaters 11 and 12 and the capacitor 18 is controlled by an on/off state of a switch 25. When the switch 25 is on, the heaters 11 and 12 are connected in parallel, and receive power supply from the capacitor 18. When the switch 25 is off, the heater 12 alone receives power supply from the capacitor 18. The heater 11 may have a rated power of 1200 W, and a heater 12 may have a rated power of 500 W, for example. In such a case, a total rated power of the heating unit comprised of the heaters 11 and 12 is 1700 W if the switch 25 is on (closed), and is 500 W if the switch 25 is off (open).

When the fuser 20 is activated (e.g., undergoing a startup operation), the switch 25 is closed to connect the heaters 11 and 12 in parallel. With the fusing roller 1 being stationary without rotation, heat is applied in the same manner as described in connection with the first through third steps based on the temperature of the fusing roller 1 detected by the temperature detecting unit 3.

When a sheet is supplied to the fuser 20, the switch 25 is placed in an off state, thereby connecting only the heater 12. With the fusing roller 1 rotating, heat is applied as described in the following in response to a detected temperature of the fusing roller 1 detected by the temperature detecting unit 3. At step S31, the fusing roller 1 is heated by supplying electric power from the capacitor 18 to the heating unit comprised of the heater 12 and having a total rated power of 500 W while the external power supply is applied to the heaters 13 and 14. At step S32, heating as described above is gradual compared with the heating unit having the total rated power of 1700 W, so that the quantity of heat provided to the fusing roller 1 by the heaters 12–14 is balanced with the quantity of heat deprived by supplied sheets. As a result, the fusing roller 1 is maintained within a range of temperature suitable for the fusing of toner. This provision makes it possible to supply electric power from the capacitor 18 to the heater 12 without frequent on/off control when sheets are supplied to the fuser 10.

As described above, the supply of electric power from the capacitor 18 to the heaters 11 and 12 does not require on/off control when sheets are supplied to the fuser 10. Because of this, the life of the on/off switches for supplying electric power from the capacitor 18 to the heating unit is extended, thereby providing the fuser 10 that is maintenance free.

The fusers 10 and 20 described above are configured such that the heating unit comprised of two heaters receives electric power from a capacitor through on/off control, and serves as an auxiliary unit to assist the heating of the fusing roller as it is heated by the heating unit comprised of two heaters that receives electric power from an external power supply all the time. Alternatively, the fusing roller may be heated only by the heating unit comprised of two heaters receiving electric power from a capacitor through on/off control.

Figure 6:
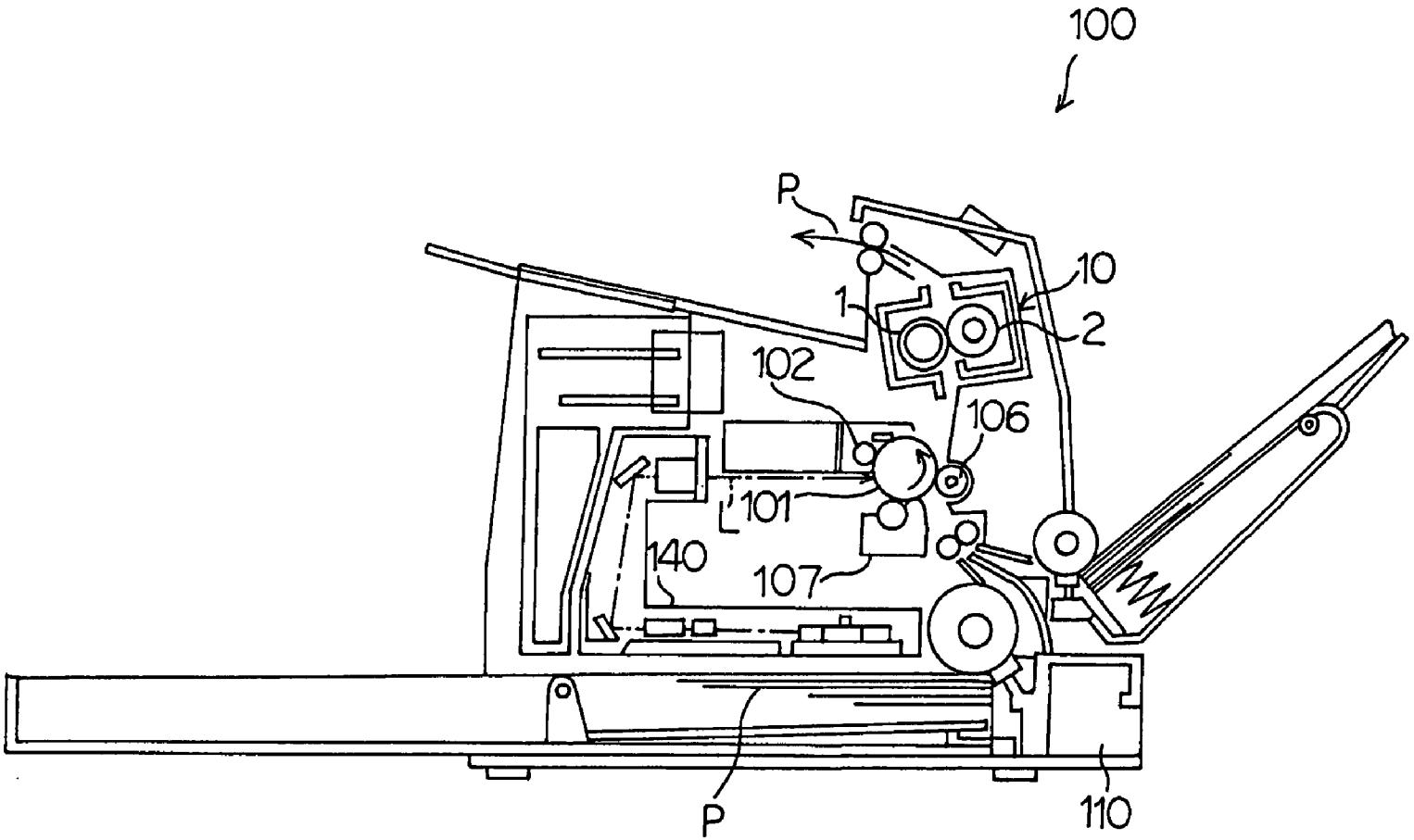
FIG. 6 is an illustrative drawing showing an example of the construction of an image forming apparatus in which the fuser of the first embodiment is incorporated.

FIG. 6 is an illustrative drawing showing an example of the construction of an image forming apparatus in which the fuser 10 of the first embodiment of the invention is incorporated. In an image forming apparatus 100 of FIG. 6, an electrophotography mechanism is provided by including a photoconductor 101 having a drum shape and serving as an image carrying unit, a charging unit 102 for uniformly charging the photoconductor 101, a laser optical system 140 shining a laser beam L and forming an electrostatic latent image on the photo conductor 101 after electrical charging, and a developer unit 107 that develops the electrostatic latent image into a toner image on the photoconductor 101. The toner image on the photoconductor 101 is transferred onto a sheet P by a transfer unit 106 as it is supplied from a sheet-feeder cassette 110. The sheet P carrying the toner image is supplied to the fuser 10, and is heated by the fusing roller 1 and the pressuring roller 2, resulting in the toner being fused with the sheet P.

When the main power of the image forming apparatus 100 is switched on, each part of the image forming apparatus 100 starts to operate, and a startup operation (activation) of the fuser 10 is also performed. That is, the supply of electric power to heaters of the fuser 10 is started, thereby commencing the heating of the fusing roller 1. The heaters 11 and 12, while being connected in parallel, generate heat as they receive electric power from the capacitor 18 as described in the first embodiment of the invention. This heat together with heat generated by the heaters 13 and 14 rapidly heat up the fusing roller 1 in a uniform manner. When sheets are supplied to the fuser 10, the heaters 11 and 12 generate heat while being connected in series, and heat up the fusing roller 1 together with the heaters 13 and 14 that are also generating heat. In the image forming apparatus 100, the fuser 20 of the second embodiment may alternatively be provided in place of the fuser 10.

Further, the present invention is not limited to these embodiments, but various variations and modifications may be made without departing from the scope of the present invention.

The present application is based on Japanese priority application No. 2003-098056 filed on Apr. 1, 2003, with the Japanese Patent Office, the entire contents of which are hereby incorporated by reference.

What is claimed is:

1. A fuser apparatus comprising:

an electricity storage device;

a first heating unit configured to generate heat based on electric power supplied from a commercial power supply;

a second heating unit configured to generate heat based on electric power supplied from said electricity storage device;

a fusing member configured to fuse toner with a sheet through heat applied by said first heating unit and said second heating unit; and a control unit configured to change a rated power of said second heating unit.

2. The apparatus as claimed in claim 1, wherein said second heating unit includes a plurality of heaters, and said control unit is configured to change a number of the heaters receiving electric power, to change the rated power of the second heating unit.

3. The apparatus as claimed in claim 2, wherein the control unit is configured to switch the rated power of the second heating unit between a first operation mode corresponding to a time period when said fusing member is heated from a temperature with no heat applied by said first and second heating units to a temperature suitable for fusing of the toner and a second operation mode corresponding to a time period when heat is deprived from said fusing member by the sheet.

4. The apparatus as claimed in claim 3, wherein all said heaters receive the electric power in the first operation mode, and at least one but not all of said heaters receives the electric power in the second operation mode.

5. The apparatus as claimed in claim 2, wherein said heaters are connected in parallel in the first operation mode, and are connected in series in the second operation mode.

6. The apparatus as claimed in claim 2, wherein the control unit is configured to change the number of heaters receiving electric power by selection of an ON/OFF state of one or more switches.

7. An apparatus for forming an image, comprising:

an electrophotography unit configured to create a toner image through electrophotography and transfer the toner image onto a sheet; and a fuser configured to fuse toner of the toner image with the sheet, wherein said fuser includes:

an electricity storage device;

a first heating unit configured to generate heat based on electric power supplied from a commercial power supply;

a second heating unit configured to generate heat based on electric power supplied from said electricity storage device;

a fusing member configured to fuse the toner with the sheet through heat applied by said first heating unit and said second heating unit; and a control unit configured to change a rated power of said second heating unit.

8. The apparatus as claimed in claim 7, wherein said second heating unit includes a plurality of heaters, and said control unit is configured to change a number of the heaters receiving electric power, to change the rated power of the second heating unit.

9. The apparatus as claimed in claim 7, wherein the control unit is configured to switch the rated power of the second heating unit between a first operation mode corresponding to a time period when said fusing member is heated from a temperature with no heat applied by said first and second heating units to a temperature suitable for fusing of the toner and a second operation mode corresponding to a time period when heat is deprived from said fusing member by the sheet.

10. The apparatus as claimed in claim 9, wherein said heaters heating units are connected in parallel in the first operation mode, and are connected in series in the second operation mode.

11. The apparatus as claimed in claim 9, wherein all said heaters receive the electric power in the first operation mode, and at least one but not all of said heaters receives the electric power in the second operation mode.

12. The apparatus as claimed in claim 7, wherein said electricity storage device is a capacitor.

13. A fuser apparatus comprising:

an electricity storage device;

first heating means for generating heat based on electric power supplied from a commercial power supply;

second heating means for generating heat based on electric power supplied from said electricity storage device;

a fusing member configured to fuse toner with a sheet through heat applied by said first heating unit and said second heating unit; and control means for changing a rated power of said second heating means.

* * * * *